US005956912A

United States Patent [19]

Carter et al.

[11] Patent Number: 5,956,912

[45] Date of Patent: Sep. 28, 1999

[54] CONTROL JOINT FOR FORMING CONCRETE

[76] Inventors: Randy Carter, 15449 N. 25th Ave., #2076, Phoenix, Ariz. 85023; Flake Thomas Carter, 37640 N. 14th St., Phoenix, Ariz. 85027

[21] Appl. No.: 09/005,371

[22] Filed: Jan. 9, 1998

Related U.S. Application Data

[63] Continuation-in-part of application No. 08/785,058, Jan. 17, 1997.

[51] Int. Cl.[6] ..... E04B 1/682

[52] U.S. Cl. ..... 52/396.02; 404/47; 404/67; 52/318; 52/367; 52/677

[58] Field of Search ..... 404/47, 49, 67; 52/318, 364, 371, 396.02, 677, 730.2, 730.6, 368, 376, 254, 793.1, 169.5, 367

[56] References Cited

U.S. PATENT DOCUMENTS

| | | | |
|---|---|---|---|
| 1,440,162 | 12/1922 | McGovern . | |
| 2,031,249 | 2/1936 | Bowman . | |
| 3,871,787 | 3/1975 | Stegmeier | 404/48 |
| 4,745,716 | 5/1988 | Kuypers | 52/169.5 |
| 4,815,247 | 3/1989 | Nicholas | 52/396 |
| 4,815,886 | 3/1989 | Madsen | 403/28 |
| 5,042,211 | 8/1991 | Nestler | 52/369 |
| 5,181,763 | 1/1993 | Dekel | 404/4 |
| 5,459,969 | 10/1995 | Stibolt et al. | 25/254 |
| 5,466,211 | 11/1995 | Komarek et al. | 493/355 |
| 5,522,196 | 6/1996 | Conroy et al. | 52/738.1 |
| 5,531,050 | 7/1996 | Stibolt et al. | 52/254 |
| 5,758,456 | 6/1998 | Case | 52/177 |

FOREIGN PATENT DOCUMENTS

| | | | |
|---|---|---|---|
| 1206379 | 2/1960 | France | 52/793.1 |

*Primary Examiner*—Robert Canfield
*Attorney, Agent, or Firm*—Gregory J. Nelson

[57] ABSTRACT

A control joint for forming and controlling concrete structures such as floors and tilt-up walls. The joint has a base and an upstanding web and is preferably extruded from plastic having a honeycomb cell structure. The honeycomb structure may include a metal reinforcing section extending within the structure along the length of the joint. The joint may be utilized to form various concrete structures such as sidewalks, pads and tilt-up walls.

10 Claims, 14 Drawing Sheets

CONTROL JOINT FOR FORMING CONCRETE

The present application is a continuation-in-part of U.S. patent application Ser. No. 08/785,058, filed Jan. 17, 1997, entitled "Control Joint For Concrete".

BACKGROUND OF THE INVENTION

FIELD OF THE INVENTION

This invention relates to a control joint for use in casting concrete sections and more particularly relates to a control joint which has a base and an upstanding web which will lock into the concrete to prevent shifting once it is poured.

As is well known, concrete foundations, sidewalks and similar concrete products have traditionally utilized wooden form work. Wooden form work has a disadvantage in that it utilizes wood sections which must be cut to size and then assembled on site and later removed. In some instances it is necessary to soak the wooden forms with oil making them heavy. Removal of wooden forms can be difficult. Furthermore, once the forms have been used, they either must be cleaned or discarded as scrap. Accordingly, the use of conventional wooden form work is time consuming, expensive and is an inefficient use of resources.

As a result, the industry has turned to other types of joints and supports for forming barriers and supports when pouring concrete structures such as floors and pads. The following are representative of the prior art in this area.

U.S. Pat. No. 4,815,886 shows a self supporting expansion joint for use in the preparation of concrete products which comprises a single unit inverted T having a flat base adapted to rest on the ground and a vertical beam perpendicularly joined to the center of the base. The beam is thicker at the point of junction with the base and at the top of the beam. In a special embodiment, the center core of the beam is prepared from by co-extrusion with a material which is more expandable and compressible than the material used in the remaining portion of the construction.

U.S. Pat. No. 4,909,002 discloses a concrete screen rail having generally parallel spaced top and bottom edges, at least the upper one of which is provided with a finished surface. A plurality of recesses are provided in a web portion of the rail. In use, the recesses in the web are closed off by a thin layer of concrete. The screen rail may be in the form of a straight beam of I-section or alternatively a general L shaped cross section. The rails are designed to become an integral part of the entire slab and to provide improved edge finish to the completed floor. U.S. Pat. No. 5,433,051 discloses a supporting element for use in casting concrete floors which includes a base member and a distinct top member supported by the base member. The top member has an elongated top sliding plane surface allowing a concrete leveling device to be moved along it. The base member is formed of side walls with openings. The base member may form a grove in the central top portion and the top member may be an elongated rail received within the grove. Foot portions connected to side walls may have leveling adjustments screws provided in them for adjusting position of the top sliding plane surface. A flexible barrier may be disposed longitudinally between the side walls. This system is commercially available and sold under the designation Combiform.

While the aforementioned systems provide certain advantages while casting concrete pads and floors and may overcome many of the significant disadvantages attendant to use of a wooden forms, there nevertheless exists a need for an improved control joint which is self supporting and will effectively lock into the concrete product.

It is a broad object of the present invention to provide a control joint which may be easily installed, leveled and will resist the tendency of the concrete to heave or vertically shift.

It is another object of the present invention to provide a control joint that facilitates screeding during finishing of the concrete product.

It is another object of the present invention to provide a control joint which may be continuously extruded and provided in sections that may easily be cut to length upon installation.

BRIEF SUMMARY OF THE INVENTION

Briefly, the present invention provides a control joint which is formed as an integrally molded section preferably of a durable thermo plastic such as polyurethane, polypropylene or polyvinyl chloride. The joint can be provided in various lengths and cut to fit at the job site. The control joint has a generally flat base and an upstanding web and in the preferred embodiment, the vertical web has an offset section at an intermediate location. Apertures are provided in the base section to accept ground stakes or other fastener components for securing the control joint to the support surface such as the ground surface. Bores located at an intermediate location along the upstanding web are provided to receive short lengths of reinforcing material such as two foot lengths of steel bar. A first pair of locking tabs extend from opposite sides of the web at a location between the upper end of the web and the offset. The locking tabs project from opposite sides of the web and extend continuously along the sides of the web. A second pair of locking tabs may be provided at a location below the offset or the bore through the web. The second pair of locking tabs also extend from opposite sides of the web and extend continuously along the sides of the web.

The control joint is utilized by placing sections of the control joint around the periphery of the area on which the concrete is to be poured and cast. The control joint sections may be leveled and secured in place by ground stakes. If required, reinforcing bars can be extended horizontally through the opening in the web. Concrete is then poured and is retained and controlled during the pour and set-up by the control joint sections. Finishing is accommodated as a screed may be supported on the upper end of the upstanding web during the finishing operation.

In other embodiments, the web has a detachable top cap to provide a chamfer or smooth seam at the surface of a completed concrete section once the concrete has set-up and the cap is removed.

In yet another embodiment, the control joint is extruded into various cross sectional shapes having a honeycomb structure to provide a light weight, strong joint. A metal insert may be formed as part of the extrusion.

BRIEF DESCRIPTION OF THE DRAWINGS

The above and other objects/advantages of the present invention will be more fully understood by reference to the following detailed description, claims and drawings in which;

FIG. 9 is a cross sectional view of a concrete structure showing yet another embodiment of the present invention used for forming the edge of a sidewalk or the like;

DETAILED DESCRIPTION OF THE INVENTION

Figure 1:
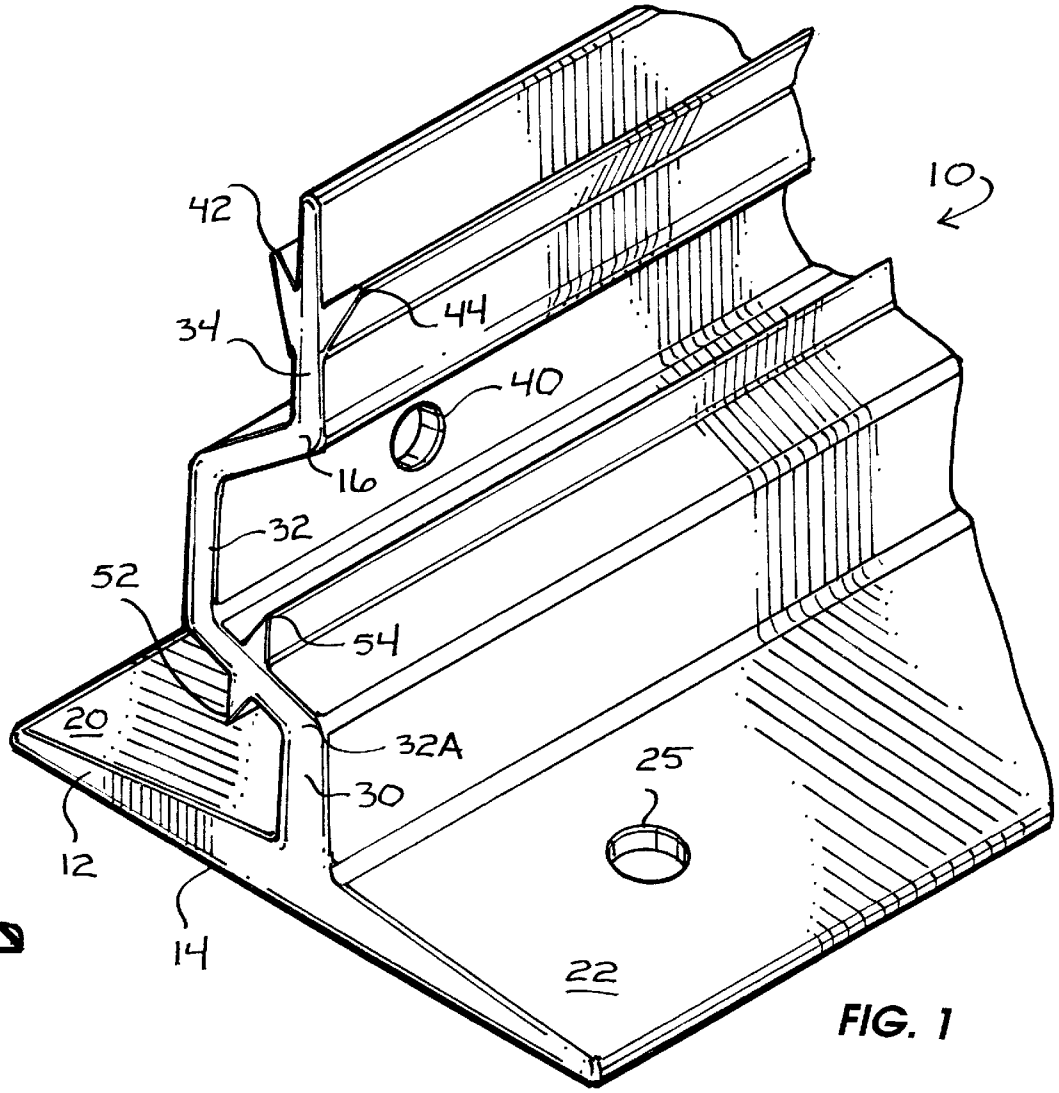
FIG. 1 is a perspective view of the control joint of the present invention.
Figure 2:
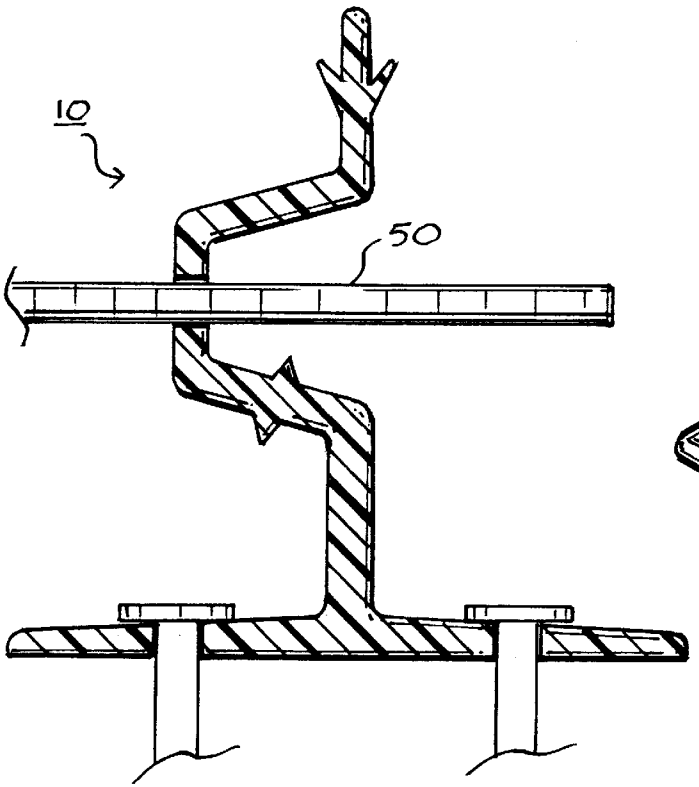
FIG. 2 is a cross-sectional view of the control joint shown in FIG. 1 showing ground stakes and a reinforcing member inserted into the control joint.

Turning now to FIGS. 1 and 2, a control joint according to the present invention is generally designated by the numeral 10 and can be provided in any convenient length. The control joint 10 has a base 12 that has a generally planar lower surface 14. A web member 16 extends vertically from the base dividing the base into oppositely extending flanges 20 and 22. Flanges 20 and 22 are provided with apertures 25 at spaced apart locations typically every 12 to 24 inches.

The upstanding web 16 has a lower section 30, an intermediate offset section 32 and an upper or distal end 34. The height of the web may be between 1½" to 12" for most applications and the control joint can be provided in different sizes to accommodate the installation of different thicknesses of concrete pads. Preferably the lower section 30, intermediate section 32 and the upper section 34 are all approximately the same height. The intermediate section is transversely off-set and preferably has a maximum off-set depth corresponding approximately to the height of one of the sections 30 32 or equivalent to approximately one third of the height of the web.

Bores 40 may be provided in the offset portion 32 at spaced-apart locations approximately every 12 to 24 inches. The bores 40 are provided for receipt of a reinforcing member such as a section of steel or re-bar 50 which may be inserted horizontally through the web offset prior to pouring the concrete in place as seen in FIG. 2.

To enhance the adherence of the concrete to the control joint, a plurality of locking tabs project from the opposite sides of the web. The first pair of locking tabs 42 and 44 oppositely extend from the upper section 34 of the web. The tabs 42 and 44 are integrally formed as part of the web and are continuous and preferably project upwardly forming an acute angle with respect to the planar surface of the web to which they are attached. The tabs may be variously sized but preferably have an overall length of approximately ¼" to ½".

It may also be desirable to provide a second pair of locking tabs at a location along the offset potion 32. Accordingly, tabs 52 and 54 oppositely project from the offset web portion 32A and have an axis generally normal to the web portion 32A.

The control joint is preferably made of a material that possesses sufficient rigidity as not to substantially deform or bend when concrete is poured adjacent one side of the web. Also, the material should be compatible with manufacturing by means of an extrusion process. Accordingly, preferred plastics are styrene, polyvinyl chloride, polyurethane and other thermoplastic materials.

Figure 8:
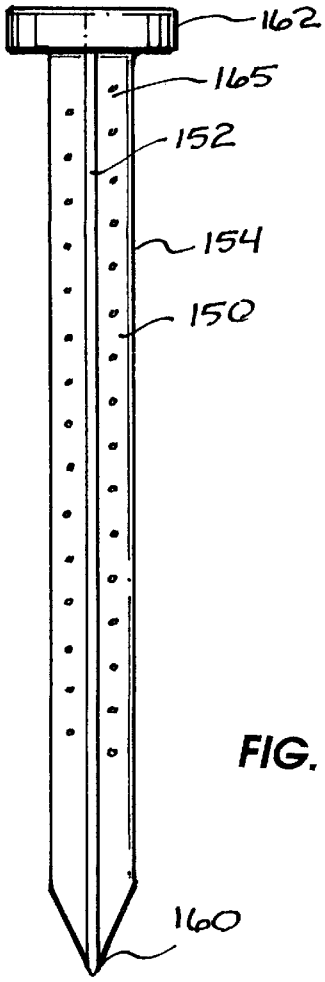
FIG. 8 is a detail view of a typical stake that may be used for securing control joints according to the present invention in place against a sub-surface.
Figure 4:
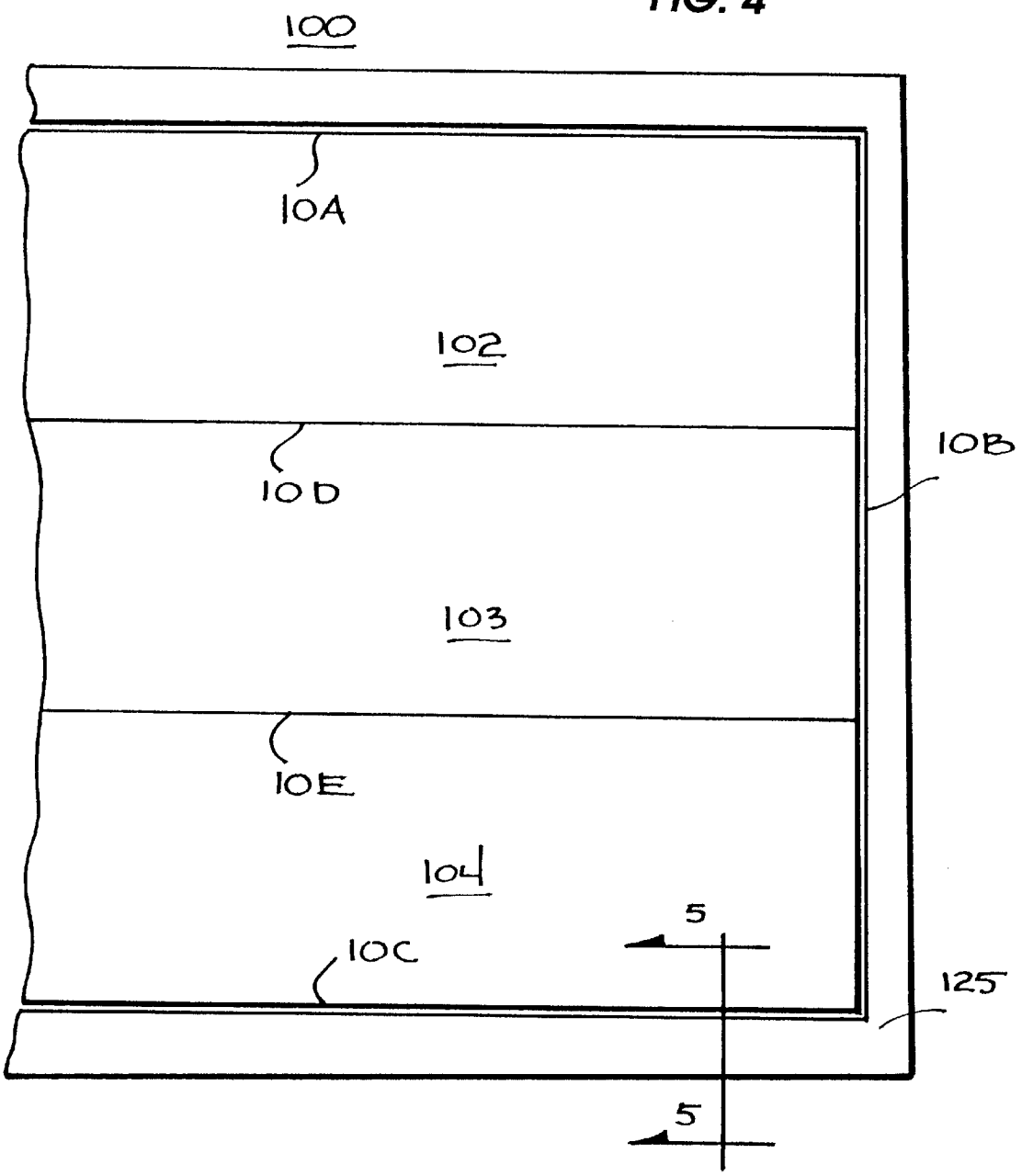
FIG. 4 is a plan view of a portion of a concrete pad showing sections of the control joint of the present invention installed about the periphery of the pour area.
Figure 5:
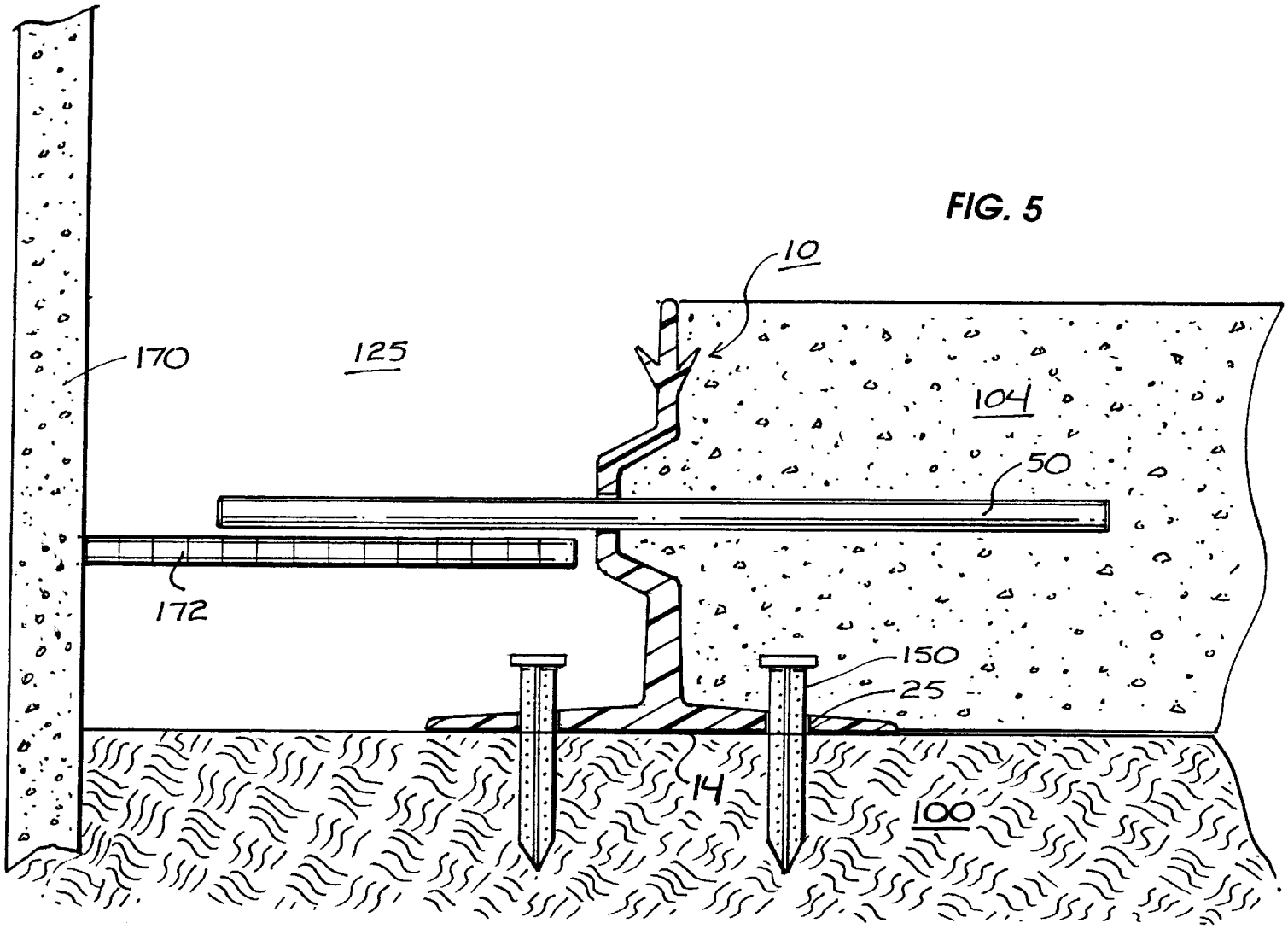
FIG. 5 is a cross sectional view taken along line 5—5 of FIG. 4.

Referring to FIGS. 4 and 5, a representative application is shown illustrating the use of the control joint of the present invention. The area in which the concrete pad is to be installed is designated by a numeral 100 and is graded and prepared in a conventional manner. The pad is a structural floor having sections 102, 103 and 104 and accordingly the periphery of the area is delineated by installing control joint sections 10A, 10B and 10C around the periphery. The left hand side of the floor as seen in FIG. 4 is not shown and may be similarly formed. In addition the plurality of longitudinally extending control joints sections 10D and 10E are positioned parallel to sections 10A and 10C at spaced-apart locations with their ends abutting the ends sections, such as section 10B. The control joints are all set in place with their flat base 14 on the graded surface 100. Leveling may be easily accomplished by placing use of the ground stakes as shown in FIGS. 2 and 8. The ground stakes 150 are preferably molded of plastic having intersecting blade sections 152 and 154. The lower ends of the blades are preferably sharpened to a point at 160 and the upper end of the leveling stakes having a head 162. The stakes are sized to be accommodated within the holes 25 in the base section of the control joint and are driven into the supporting ground surface 100 a sufficient distance to achieve stability. If leveling is required, a plurality of spaced apart holes 165 extend axially along the blades 152 and 154. The installer may simply insert a small pin such as a nail, in one of the selected holes 165 adjacent the underside of the base. This will support the joint in the desired horizontal position.

Once the control joints have been installed as shown in FIG. 4, suitable reinforcing can be put in place. The structural reinforcing may include re-bar or wire. In addition, lengths of reinforcing member such as re-bar or steel sections 50 can be inserted at selected holes 40 through the web of the control joint sections 10D and 10E. Concrete, generally the premixed type is delivered to the job site by a truck and conveyed to the sections 102, 103 and 104. Operations including tamping, screening, and finishing are performed. The upper surface end of the control joint provides a convenient surface for screening operations as a screening tool may be run across the edge of parallel and adjacent joints to level the wet concrete.

The structural floor shown in FIGS. 4 and 5 is the type often used for buildings which have tilt-up walls. The tilt-up walls, such as wall 170, are cast in place on the pad or floor sections 102, 103 or 104. Once the pad or floor is set-up the walls 170 are then tilted upwardly in place. Conventionally, a pour-back area 125 extending around the periphery is poured after the floor is set up and provide a footing area for the walls and the walls may include suitable tie-in members 172. The control joints will serve to securely lock together the previously poured structural floor and the later poured peripheral pour-back area 125.

Figure 3:
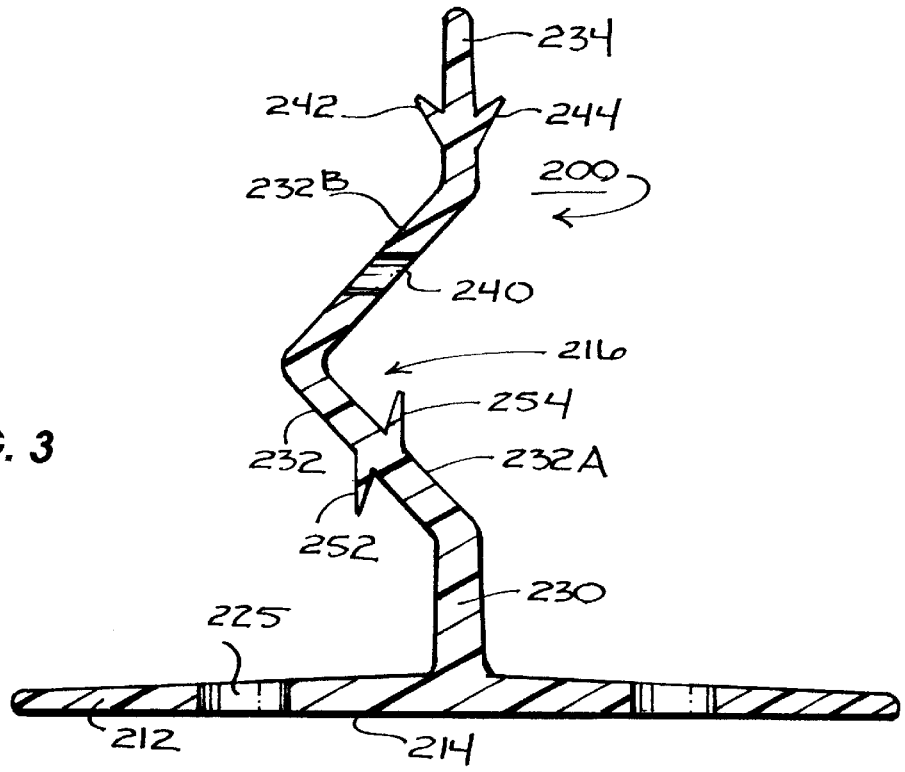
FIG. 3 is a cross-sectional view of yet another embodiment of the control joint of the present invention.

FIG. 3 shows an alternative embodiment of the control joint of the present invention which is generally designated by the numeral 200 and includes a base 212 having a flat or planar bottom 214. Apertures 225 are provided in the base for receipt of ground stakes or other securement means. An upstanding web 216 projects from the upper surface of the base and has a lower portion 230, intermediate section 232 and an upper section 234. The intermediate section 230 is offset and consists of two generally planar sections 232A and 232B which converge in a general V-configuration. An aperture 240 extends through the offset section 230 to provide for insertion of a reinforcing member as been previously explained.

A first pair of locking tabs 242 and 244 extend from the opposite sides of the upper section 234 of the web. The locking tabs form an acute angle with respect to the planar surface of the opposite sides of the web. In addition a second pair of locking tabs 252 and 254 project from the opposite sides of section 234A of the offset section 232.

The embodiment of FIG. 3 is fabricated in the same manner as has been described with respect to the previous embodiments and is installed and performs in the same manner. The offset 232 along with the locking tab provide good adherence, control and stability to cast concrete sections on either side of the control joint. Further, the control joint, because of its offset also resists heaving and shifting of the concrete during pouring and set-up.

Figure 6:
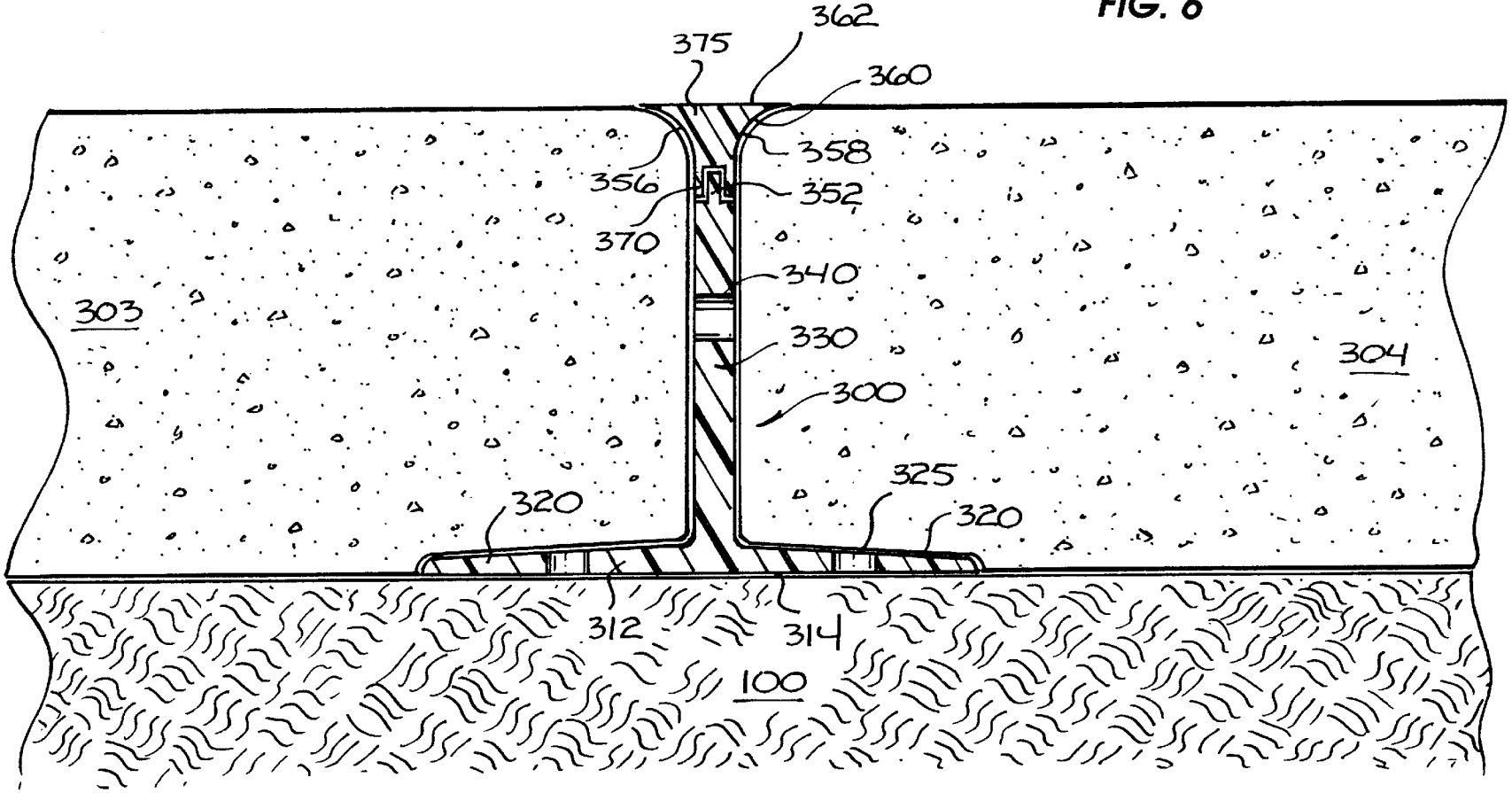
FIG. 6 is a cross sectional view through a section of concrete showing yet another embodiment of the control joint of the present invention having a detachable top cap.

FIG. 6 shows yet another embodiment of the present invention generally designated by the numeral 300. The control joint 300 again has a base 312 with oppositely extending flanges 320 and 322. An upstanding generally vertical web 330 projects from the base. The underside 314 of the base is generally planar which in use can rest on a surface such as the sub-grade 100 shown in FIG. 6. Embodiment 300 of FIG. 6 is particularly useful in pouring concrete structures such as sidewalks in which a control joint is required at spaced intervals as well as a transversely extending break line 360 which is visually acceptable.

The control joint 300 is placed at spaced-apart intervals, as for example extending transversely between the edge forms defining the adjacent sections 303 and 304 of a sidewalk on grade 100. The upper edge of the upstanding web 330 is provided with one portion of an interlocking member shown as an upwardly extending tab 352. A removable cap 375 has an upper flat surface 362 and downwardly curved, converging sides 356 and 358. The bottom edge of the top 360 has the other component of an interlocking assembly consisting of a groove 370 which receives the tab or projection 352 at the upper end of the web 330. Once the adjacent concrete sections 303 and 304 have set up, the top 375 may be removed leaving the web and base portion of the control joint in place and also providing a smoothly contoured and visually acceptable seam at the edge of the finished concrete sections 303, 304. It will be understood that embodiment 300 may include an off-set such as that shown in FIGS. 1 and 3 and is also provided with spared-apart holes 340 in the web.

Figure 7:
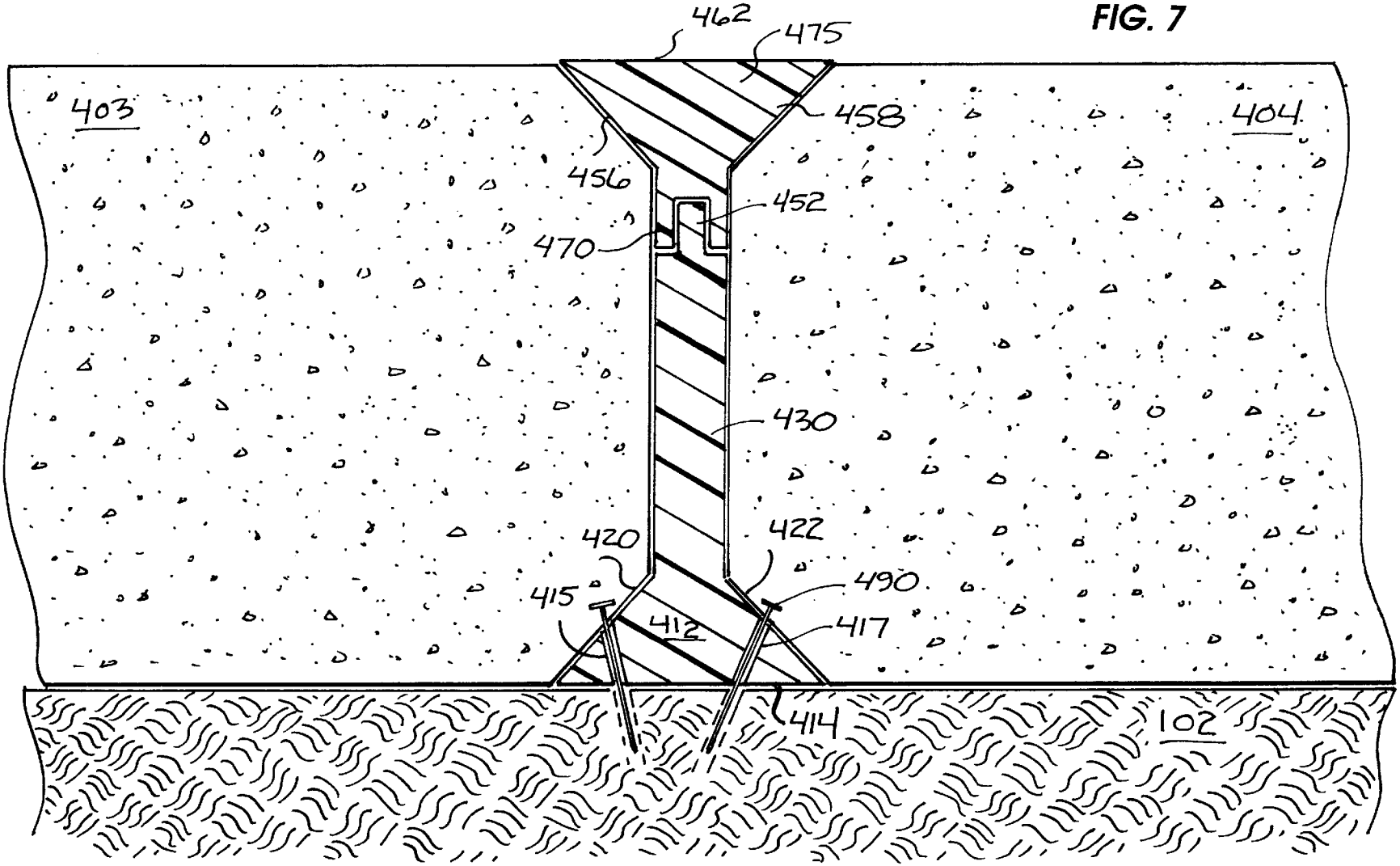
FIG. 7 is a cross sectional view through a concrete section showing yet another embodiment of the present invention used for forming structures such as tilt-up walls.

FIG. 7 shows yet another embodiment of the present invention generally designated by the numeral 400. In this embodiment, the base 102 is a concrete pad or floor that has been cured and set up such as that shown in FIG. 4. The adjacent concrete members 403 and 404 are tilt-up wall sections which are formed in place on an existing concrete pad 102 as has been described. It is conventional practice to cast the tilt-up walls in place on existing floor with application of a suitable release agent or film between the existing floor 102 and the tilt-up panels 403, 404. Adjacent tilt-up panels 403 and 404 are separated by control joint 400 which has a base 412 and an upstanding web 430. The base 412 has a generally planar lower surface 414. Angular or chamfered surfaces extend from the edges of the base 412 to the web 430 at approximately 45° and are represented by the numerals 420, 422. Bores 415 and 417 extend angularly through the base sections 420 and 422, respectively.

The upper end of the web 430 is provided with an interlocking member 452 which is shown as a projecting tab centrally located on the web and extending axially along the web. A cap or top 475 is detachably secured to the web. The top 475 has a generally flat or planar upper surface 462 and downwardly converging chamfered sections 456 and 458 which intersect an interlocking section having an axially extending groove 470. Thus, prior to pouring the tilt-up sections 403, 404 in place, the control joint is secured at a suitable location by fasteners 490, which may be concrete nails or similar fasteners. The fasteners 490 are driven through bores 415 and 417 in the opposite base sections 420, 422. Generally aligned bores 495 may also be drilled in the floor 102. With the control joint positioned as shown and cut to the desired length, the tilt-up wall sections 403, 404 can be formed in conventional manner. Once the sections 403, 404 are cured, the top 475 of the control joint can be removed by disengaging the top from the web at the interlocking members 470 and 452. This allows the tilt-up wall sections to be vertically tilted. The base 412 will remain in place during the tilt-up procedure and may later be removed.

The advantage of this control joint is that it allows chamfers to be provided at the opposite edges of the tilt-up walls so that when the tilt-up walls are in place in vertical abutment, a suitable sealant may be applied in the chamfered area. Since the top 475 is removable, tilting of the walls upwardly from the floor 102 may be accomplished without interference.

Figure 9:
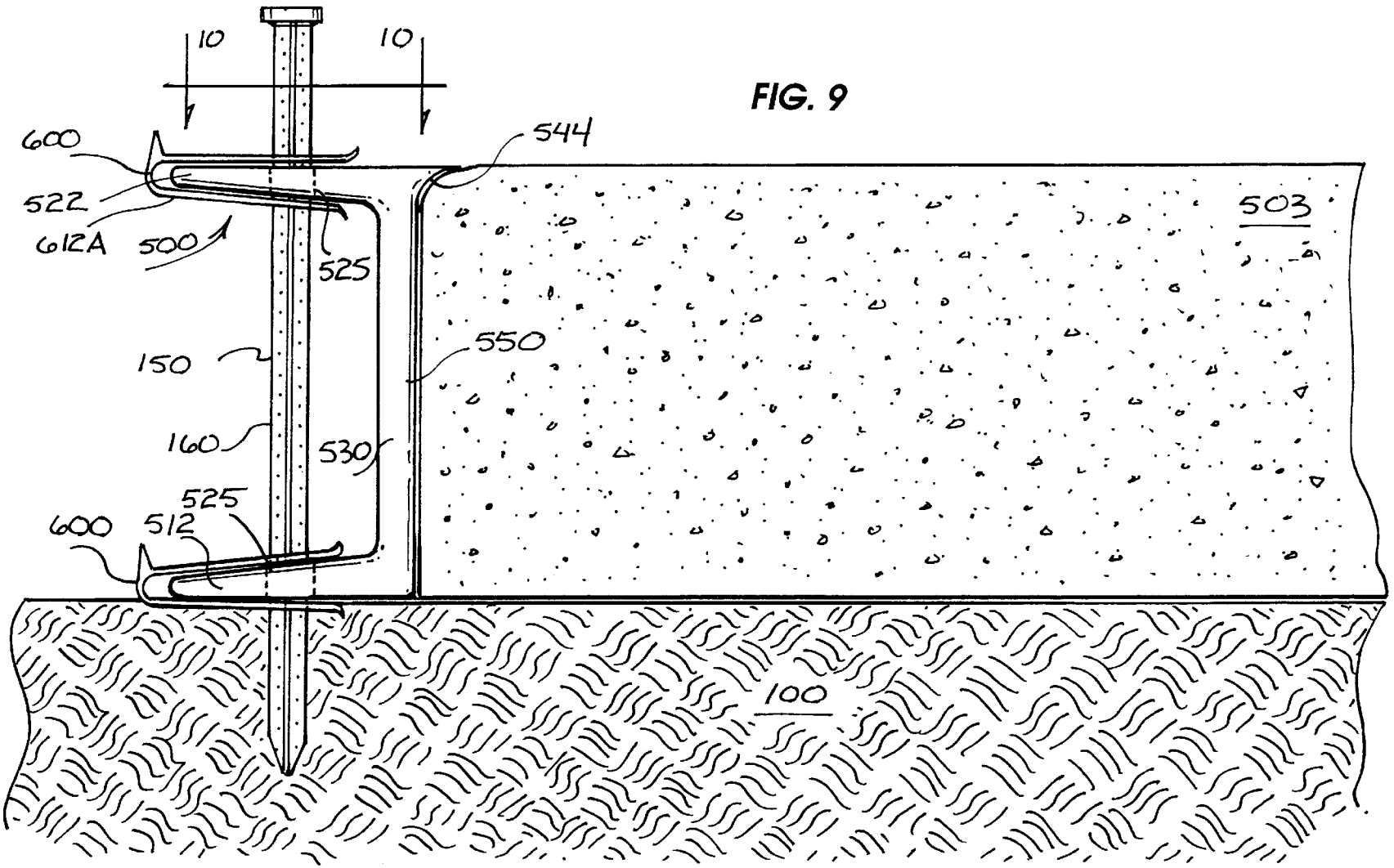

FIG. 9 shows yet another control joint according to the present invention designated by the numeral 500. Control joint 500 of FIG. 9 is particularly suited for establishing and forming the opposite sides of concrete structures such as sidewalks. The control joint of FIG. 9 will work well with the control joint shown in FIG. 6 as the control joint in FIG. 6 may be used to establish transverse control joints at spaced-apart locations between the edge control joint 500 of FIG. 9.

Control joint 500 is channel-shaped and has a base 512 and an upstanding web 530. Base 512 extends only from one side of the web 530. An upper flange 522 extends from the upper end of web 530 so that the lower base or flange 512 and upper flange 522 are generally parallel. Once surface 550 of the web 534 is generally planar and provides the forming surface for the concrete. The upper end of surface 522 may be curved away from surface 525 at 544 so as to provide a smooth edge at the intersection of the vertical and horizontal surfaces of the concrete structure 503 which is being constructed. The concrete structure 503, as indicated, may be a sidewalk supported on a base 100.

Control joint sections 500 are secured in place by a ground stake such as ground stake 150 which is shown in detail in FIG. 8. The ground stake is inserted vertically through the bores 525 in the upper and lower flanges 512 and 522 sufficiently to penetrate into the base 100. The ground stake 150 may be driven into a full depth or may be secured as shown in FIG. 9 by means of a pair of clips 600.

Figure 10:
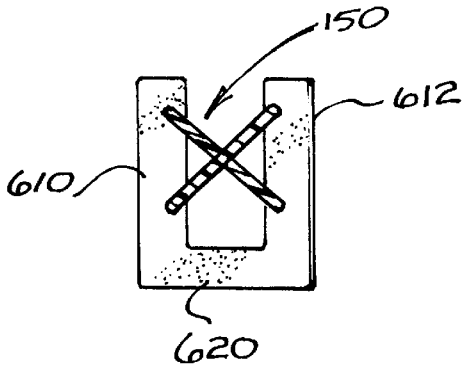
FIG. 10 is a sectional view taken along line 10—10 of FIG. 9.

The clips 600 are best seen in FIG. 10 and are fabricated from a suitable material such as stainless steel and serve as leveling clips. The clips have a generally elongated U-shape in cross section as seen in FIG. 9 and in the plan view have upper legs 610 and 612 joined across section 620. Lower legs 610A and 612A are spaced apart from the upper legs 610, 612 so that the legs may be spread apart and inserted over the flanges of the control joint as shown in FIG. 9. The ground stake 150 is preferably fabricated of plastic so that when the ground stake is inserted in the bores 525 in the flanges, the clips will engage the edges of the ground stake 150 with sufficient "bite" to secure the stake at a desired position as seen in FIG. 10.

Figure 11:
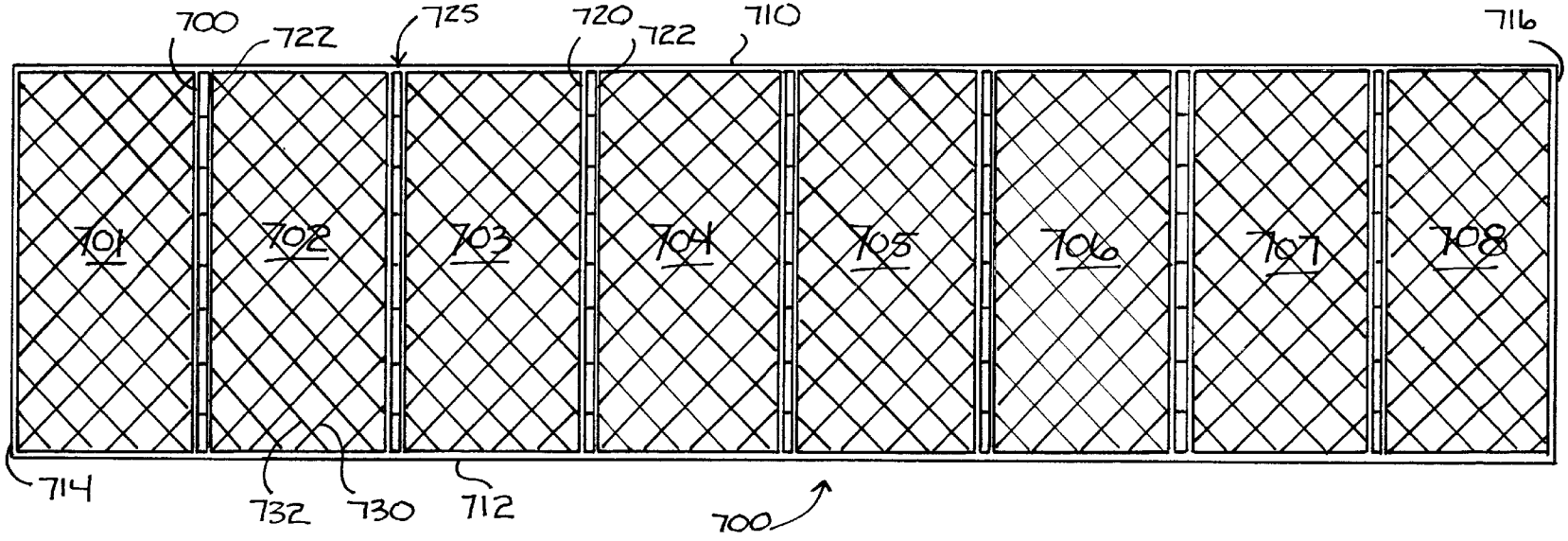
FIG. 11 is a side view of a form that may be used for forming structures such as stem walls.
Figure 12:
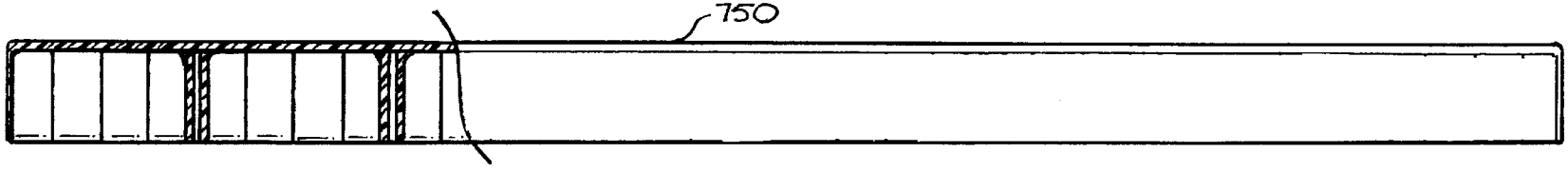
FIG. 12 is a top view of the form shown in FIG. 11.

FIGS. 11 and 12 show another embodiment of the present invention which is a form for casting concrete structures such as stem walls. This embodiment is generally designated by the numeral 700 and has a plurality of interconnected sections 701 to 708, as shown. The form 700 can be provided with any desired number of sections. The form has a continuous top wall 710 and a planar bottom wall 712 and opposite end walls 714 and 716. At predetermined, spaced-apart locations, as for example every twelve inches, a pair of spaced-apart dividers 720, 722 extend vertically between the top and bottom walls. A space 725 is provided between the dividers so that the panel can be cut to a desired length at any location between dividers. For example, if each of the sections 701, 702, 703 and 704 are twelve inches in width, the section shown in FIG. 7 could be divided into two four-length sections for forming a four foot length of a stem wall.

In order to provide suitable structural strength, the form is provided with structural support in the form of angularly-extending ribs 730 and 732 which intersect in the general honeycomb pattern. The panel is fabricated as an integrally formed molded member from a suitable plastic material. The forming surface 750 is planar and is positioned vertically in a use-position to establish one side of a concrete wall structure. A similar form would be disposed in an oppositely facing position with its vertical surface 725 establishing the opposite side of the wall of the concrete structure to be poured. The forms can be temporarily secured in place by ground stakes or other means.

Significant advantages of the form shown in FIGS. 11 and 12 are reusability and the light weight of the forms. Conventional practice is to use wooden forms which are soaked in oil so that they will suitably release once the concrete is cured. The oil-soaked wooden forms are extremely heavy and cumbersome. The smooth plastic surface 750 of the forms easily separate or release from the concrete once it is set up. Further, since the forms are molded plastic, they are light weight, generally impervious to weather and the elements and may be re-used numerous times. Also, as indicated above, the forms may be cut to provide it in lengths and cut to the desired length at the job site. If additional lengths are required, form sections can be abutted and attached by suitable spring clips similar to the spring clip shown in FIG. 10.

Figure 13:
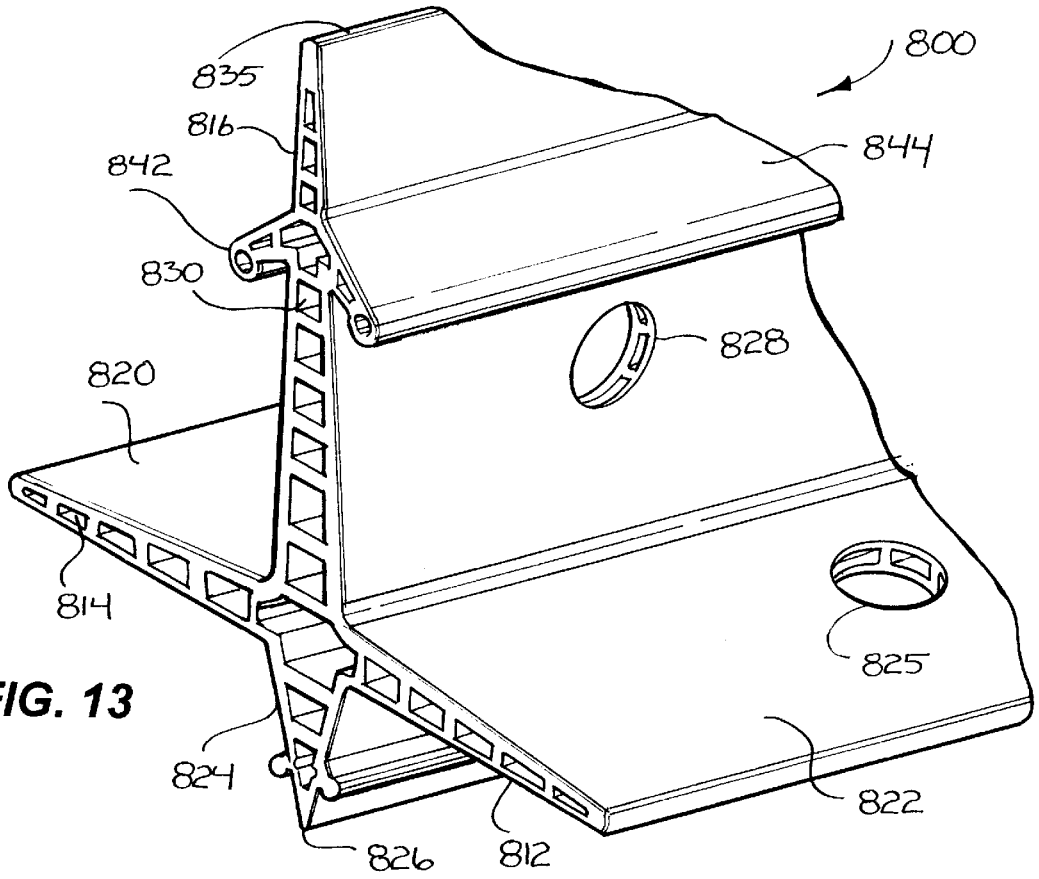
FIG. 13 is a perspective view of an alternate view of the control joint of the present invention having a honeycomb structure.

FIGS. 13 through 15A illustrate yet another embodiment of the control joint of the present invention and its use. In FIG. 13 a control joint is generally designated by the numeral 800 and has a base 812 with a generally planar bottom surface 814. A web member 816 extends vertically from the base dividing the base into oppositely extending flanges 820 and 822. A projection 824 depends from the planar base at an intermediate location. Preferably projection 824 has a taper and is pointed at its lower end 826. The web 816 has an upper edge 835 and arms 842 and 844 oppositely extend from the web at an intermediate elevation. The flanges 820 and 822 are provided with apertures 825 at spaced apart locations to accept ground stakes. Apertures 828 are provided in the upstanding web 816 for insertion of re-bar or similar reinforcing materials.

The control joint is preferably fabricated from a material that possesses sufficient rigidity so as not to deform or bend when concrete is poured adjacent one side of the web. It is preferred that the material is a plastic such as styrene, PVC, polyurethane or similar material which can be extruded. The material is preferably extruded having a plurality of longitudinally extending open cells 830 forming a honeycomb configuration. The extruded, open cell honeycomb configuration provides a control joint with the requisite strength and yet one which is light weight and reduces the amount of material required to fabricate the joint.

Figure 14:
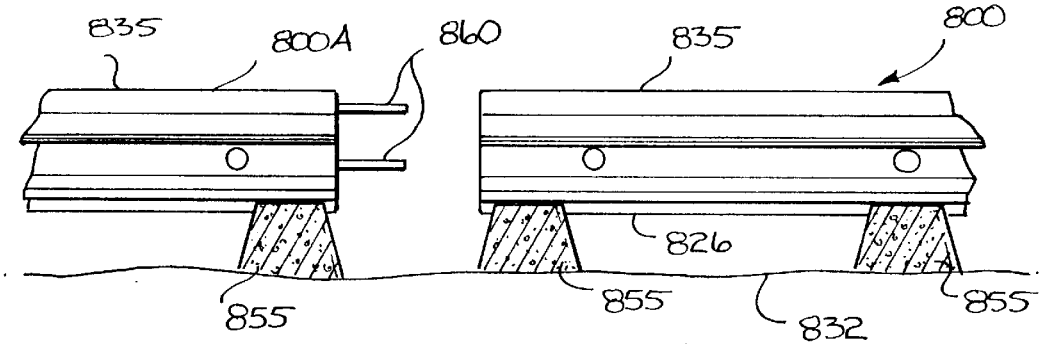
FIG. 14 is a side view showing the installation of the control joint of FIG. 13 on leveling pads.
Figure 15:
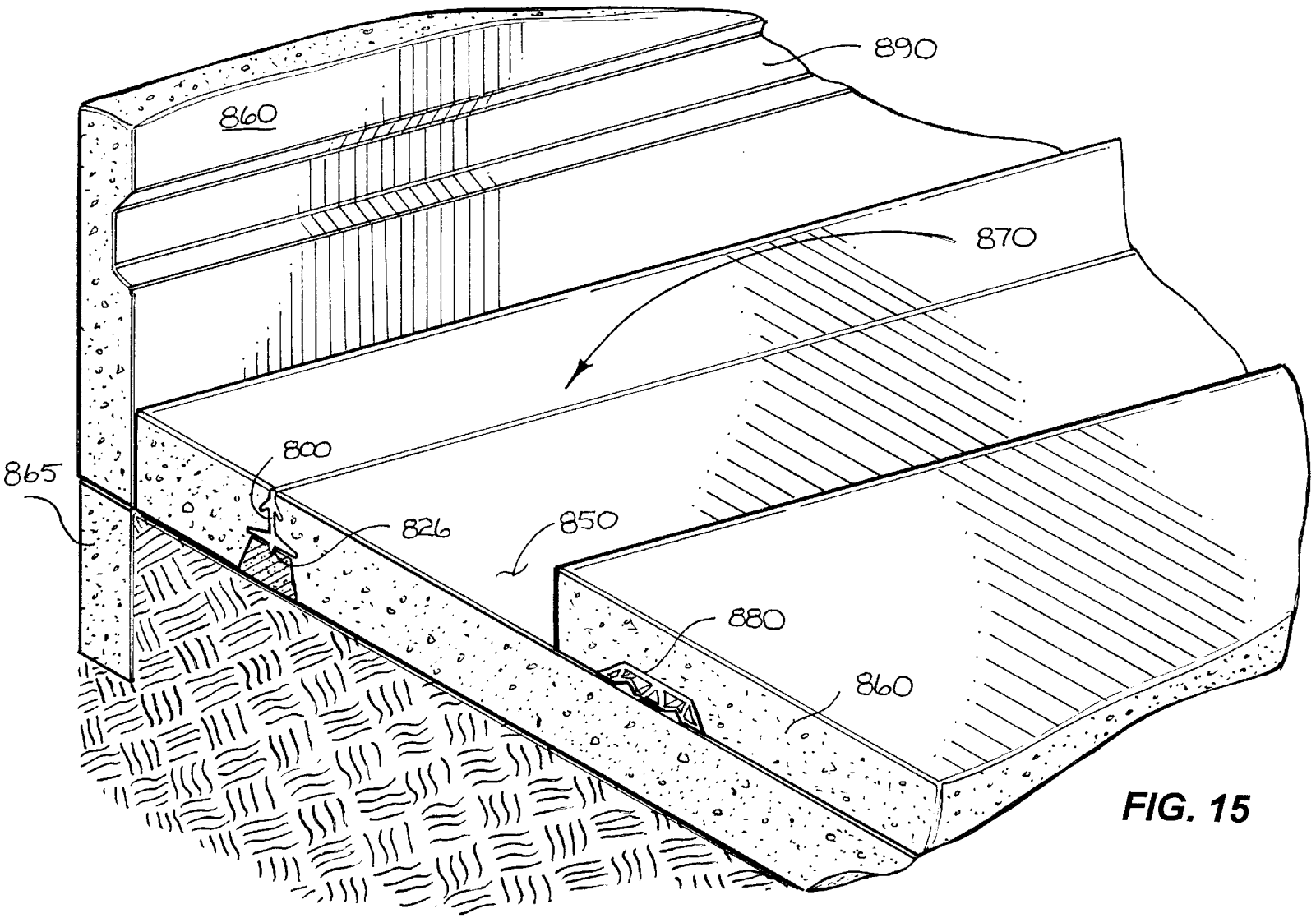
FIG. 15 is a view partly in section illustrating the completed floor and tilt-up wall structure utilizing the control joint shown in FIGS. 13 and 14.
Figure 15A:
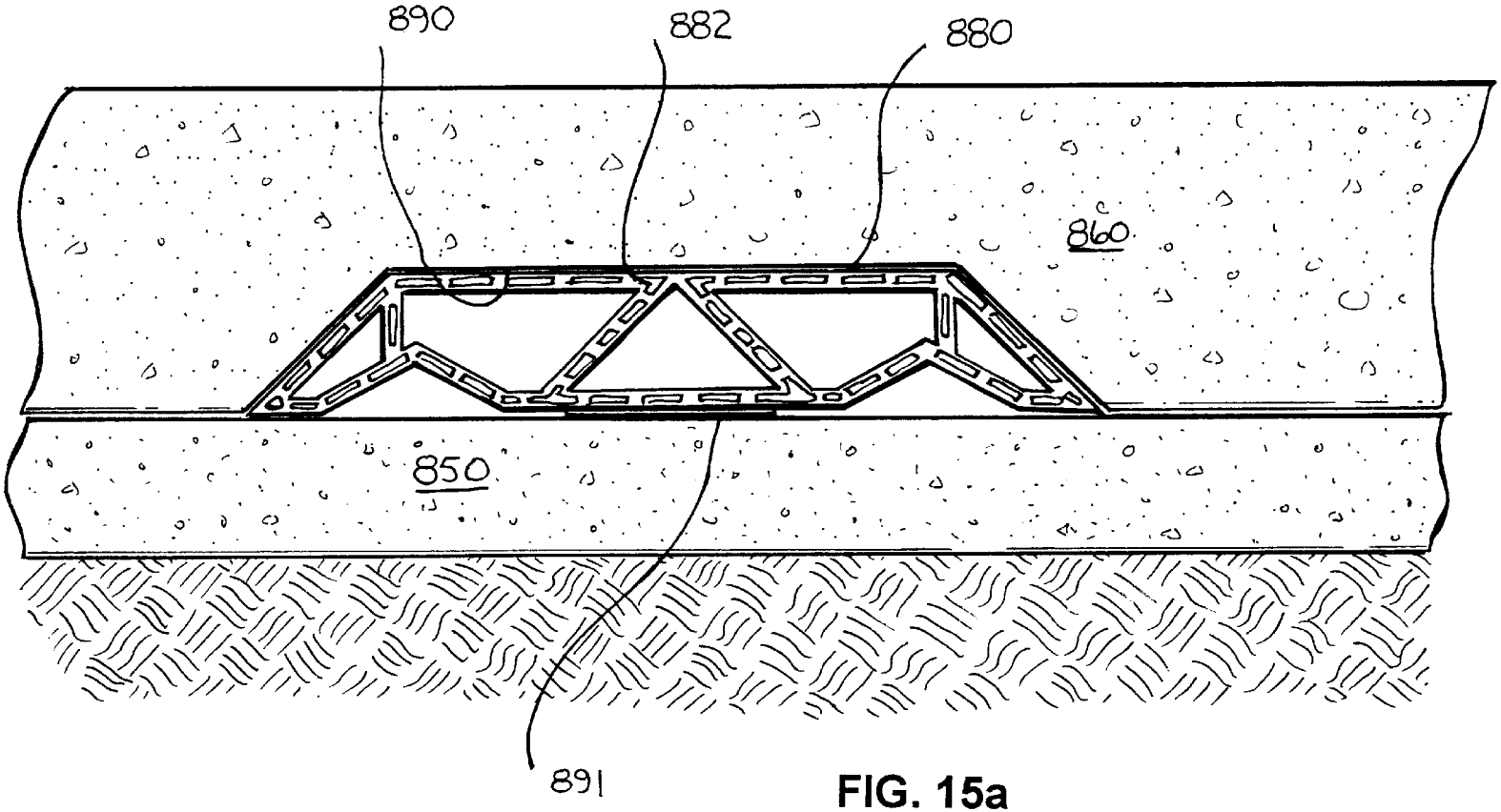
FIG. 15A is a perspective view of a form for applying an architectural treatment or reveal to a tilt-up wall surface.

Referring to FIGS. 14, 15 and 15A, a representative application is shown illustrating the use of the control joint 800. The control joint 800 has particular application to commercial construction using tilt-up walls. Accordingly, area 832 is graded and the periphery of a concrete pad 850 is delineated by positioning the control joints to form the edge of the concrete pad 850. The control joints 800 are positioned on leveling pads 855 which are established at intervals using a wet concrete. The projections 826 serve to stabilize the control joints. This way the upper edge 835 of the webs can be precisely and easily leveled. Adjacent sections 800 and 800A of the control joint as seen in FIG. 14 can be secured together by use of pin-like connectors 860. The honeycomb construction facilitates insertion of the pins into the open cells 830. The extending ends of the pins can then be inserted in the cells of the open end of the next adjacent control joint section so that the necessary length can be assembled.

Referring to FIGS. 15 and 15A, once the control joints are in place, the pad 850 can be poured abutting the control joints. Once the concrete slab 850 has set up and is firm, it is normal practice in tilt-up wall construction to use the surface of pad 850 for forming the tilt-up walls 860. The tilt-up walls 860 are cast in place on the surface of slab 850 preferably using a control joint such as shown in FIG. 7. The individual sections of the tilt up walls may be variously dimensioned and can be typically as much as 20 feet wide and 20 to 50 feet in length. Preferably, the inner or outer surfaces of the tilt-up wall may be fabricated having an architectural feature for aesthetic purposes. Accordingly, forms 880 may be positioned on the pad 850 so that an appropriate reveal design is created in the surface finished wall. FIG. 15A shows a typical form 880 which is elongated having a desired cross-sectional shape shown as trapezoidal. The cross section includes a grid or honeycomb structure 882 for strength. The form 880 is extruded from a suitable plastic of the type described above and is cut to length at the job site. The form 880 has the advantage of being light weight and is reusable as compared to conventional wood forms used for this purpose. An adhesive, such as double sided type 890, is applied to the bottom of the form 880 so that the form 880 is removably secured to the pad 850. Once the tilt-up wall sections are formed in place, they are lifted by heavy equipment such as a crane to a vertical position as shown in FIG. 15 and positioned on a footing 865 which has been previously poured. The form 880 can then be raised. Note the footing 865 and the wall 860 is spaced a predetermined distance from the control joint 880. This area is termed a pour back area 870 and is then filled with concrete to the elevation of the control joint. The completed structure is as appears in FIG. 15 and the reveal feature 890 is cast in the wall.

Figure 16:
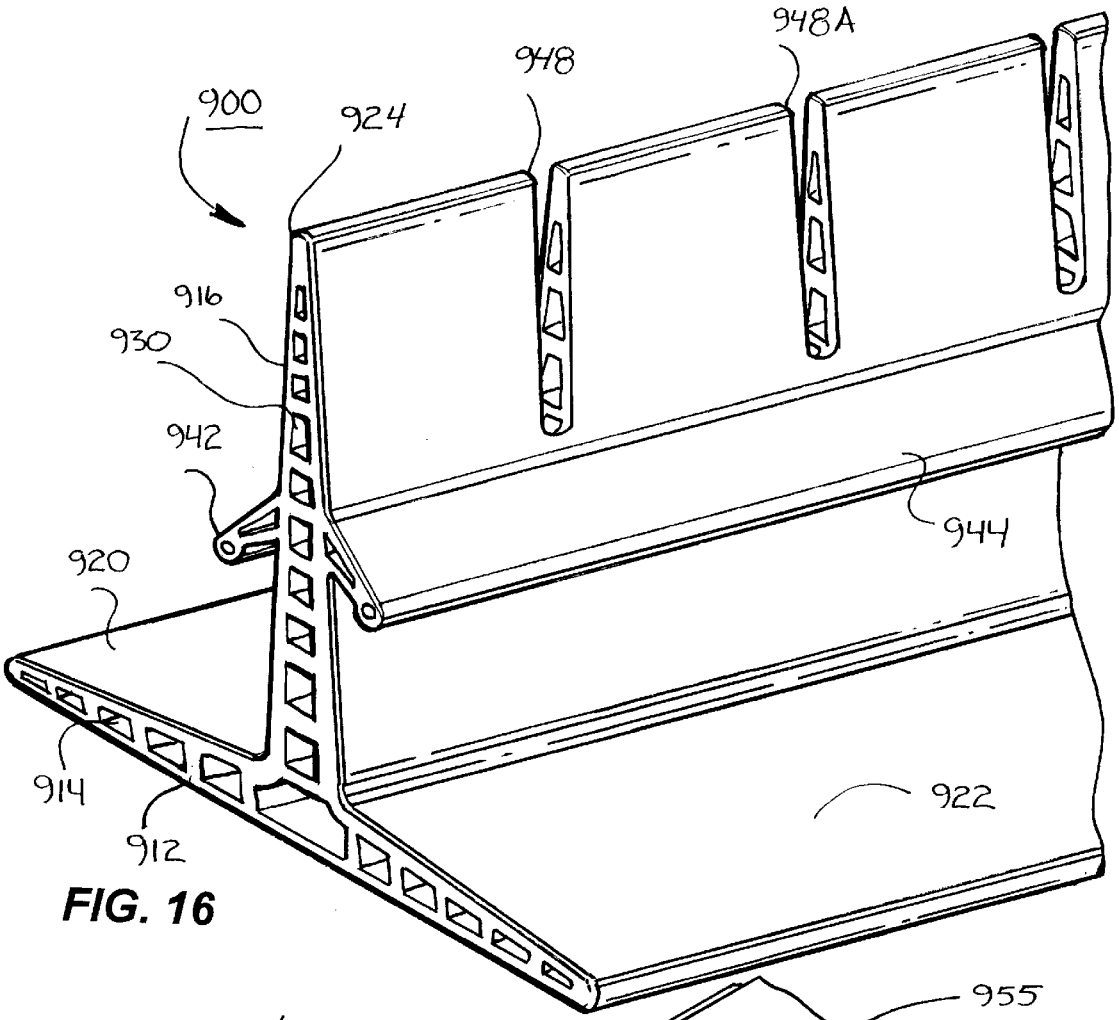
FIG. 16 is a perspective view of yet another embodiment of the joint present invention of a type used in conjunction with reinforcing mesh.
Figure 17:
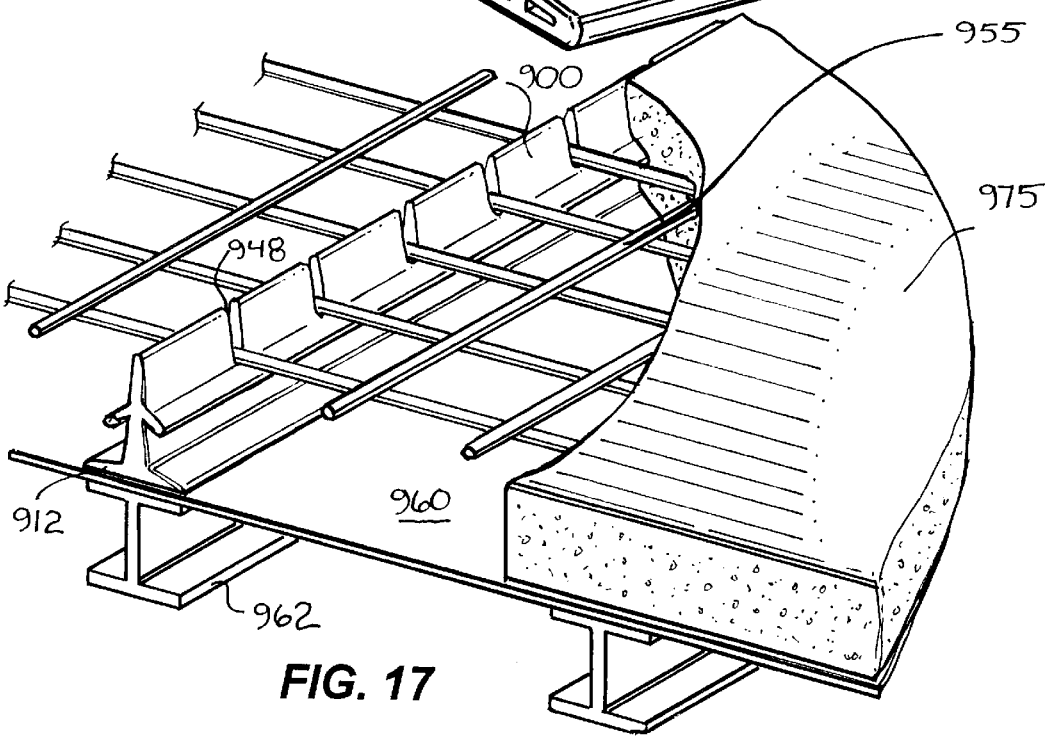
FIG. 17 is a perspective view showing the installation and control joint of FIG. 16 on a deck with reinforcing mesh installed thereon.

FIGS. 16 and 17 show yet another embodiment of the control joint of the present invention which is generally indicated by the numeral 900. Control joint 900 again has a base 912 having a generally planar bottom surface 914. A vertical web 916 projects from the base at an intermediate location dividing the base into flange sections 920 and 922. The web is again preferably an extruded plastic member which is formed having a honeycomb structure with open cells 930 for weight reduction. Also, as pointed out above, the honeycomb structure easily facilitates connection of adjacent sections of control joints by use of pins which are insertable in the honeycomb structure cells.

The web has a pair of oppositely extending arms 942 and 944 at an intermediate location. The arms are helpful in maintaining the control joint in position once concrete is poured in abutment against the side wall of the web. The control joint 900 is particularly useful in the installation of concrete floors on decking such as steel decking. To this end, the web is provided with a series of vertically extending, spaced-apart slots 948, 948A, etc., which extend from the upper edge 924 of the web to a location just above the oppositely extending arms 942, 944. The vertical slots 948 and 948A are spaced apart corresponding to the grid spacing of wire mesh reinforcing 955 of the type conventionally used in construction of this type. Typical spacing between vertical slots would be 4" to 6".

Referring to FIG. 17, in use, the control joints 900 are positioned at suitable locations on deck 960. Deck 960 is typically a metal deck supported on beams or joists 962 as would be conventional in multi-storage construction. With the control joint in place, the reinforcing grid 955 is horizontally positioned with the grid members inserted into the slots 948, 948A, etc. Once in place the grid is positioned in a horizontal position elevated from the deck 960. Concrete 975 may then be poured. The control joint will serve as a reference for leveling and finishing the concrete and also will control cracking, and to some extent, will help in preventing or accommodating expansion.

Figure 18:
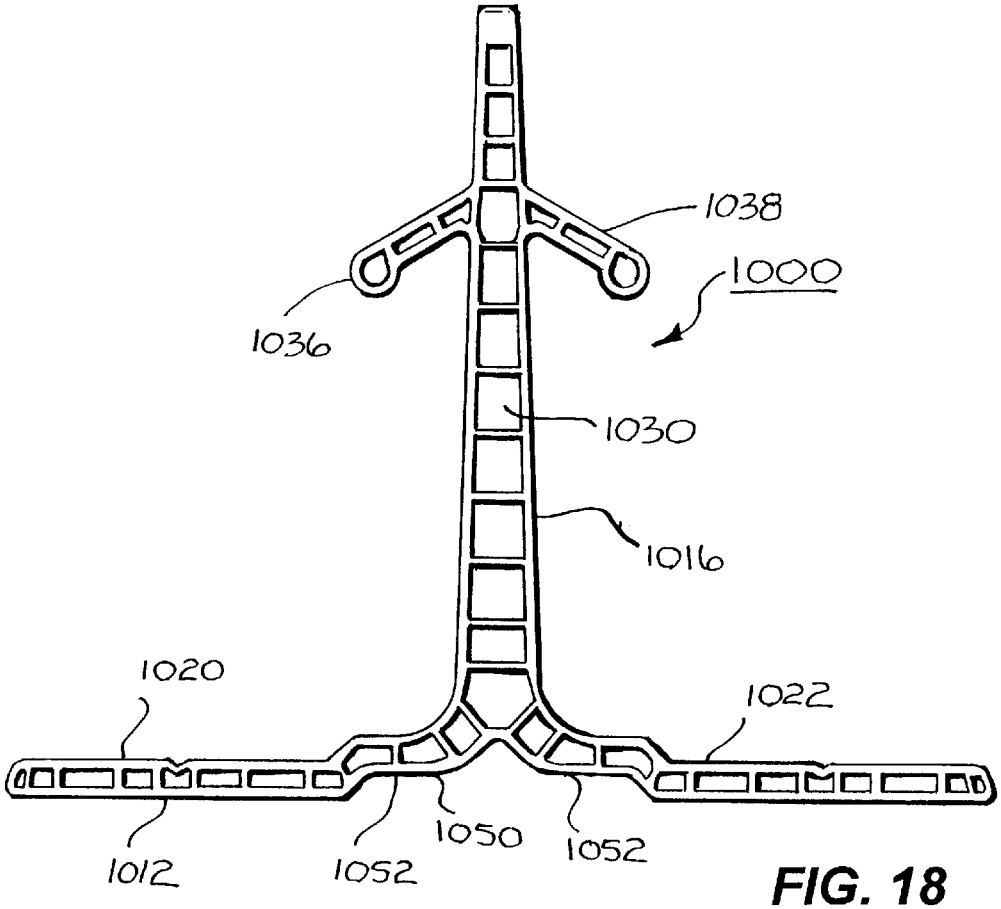
FIG. 18 is a cross sectional view of yet another embodiment of the control joint according to the present invention.

FIG. 18 shows yet another embodiment of the control joint of the present invention generally designated by the numeral 1000. Control joint 1000 is similarly fabricated having a base 1012 from which extends a vertical web 1016. Flanges 1020 and 1022 extend oppositely from the lower end of the web in a generally inverted T-shape configuration. Arms 1036 and 1038 oppositely project from the sides of the web at an intermediate location. The arms may be perpendicular with respect to the web or may be angular as shown in FIG. 18. The arms will assist in maintaining the control joint in intimate contact with the concrete port along the side of the web. Also, the arms 1036, 1038 will assist in controlling cracking as the concrete dries.

Preferably, the control joint shown in FIG. 18 is an extruded member fabricated of plastic and, again, having a honeycomb construction with open cells 1030.

Figure 19:
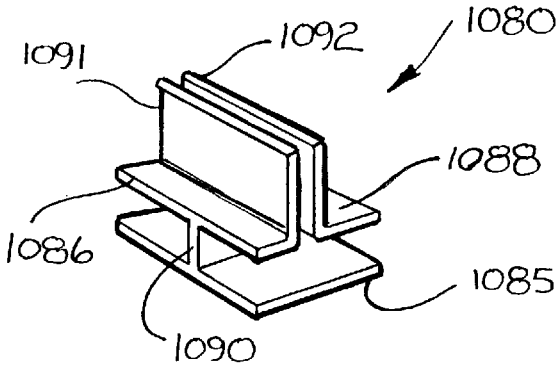
FIG. 19 is a perspective view showing a clip for attaching adjoining sections of control joints of the type shown in FIG. 18.

The intermediate portion of the planar base 1020 defines a recess 1050. The recess 1050 may be any convenient shape but is shown being V-shaped at 1052 having an apex aligned with the center of the web. This recess facilitates insertion of a clip 1080 as shown in FIG. 19 for joining additional sections of the web. As pointed out above, adjacent control joint sections can be secured together by inserting a pin into the honeycomb cells 1030 or a specially configured clip as shown in FIG. 19 and designated by the numeral 1100 may be utilized. The clip 1080 has a base 1085 which is engaged in the recess 1050 in the underside of the control joint. Tabs 1086 and 1088 are spaced from the base on vertical wall 1090. Adjacent sections of the control joint may then be joined by applying the clips 1080 to the base and web section of adjacent control joint sections. Walls 1091 and 1092 engage the sides of the webs of adjacent joints.

Figure 20:
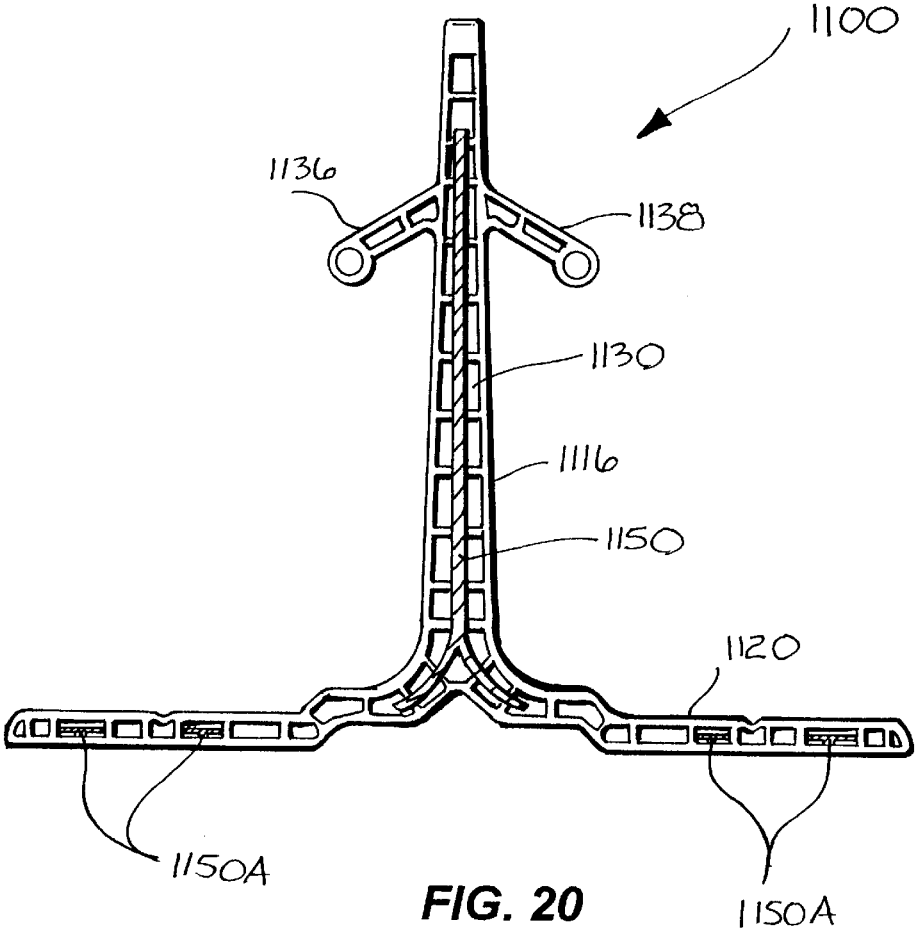
FIG. 20 is a cross sectional view similar to FIG. 18 showing yet another embodiment of the control joint of the invention.

FIG. 20 illustrates an embodiment 1100 fabricated having a shape similar to FIG. 18 with base 1120, upstanding web 1116, arms 1136 and 1138. The control joint 1100 is extruded having an open cell construction 1130. The material is preferably a plastic or a metal such as aluminum and as part of the extrusion, a metal reinforcing member 1150 is either simultaneously formed or embedded in the extrusion at the time of fabrication. The insert 1150 may be T-shaped or other shape to provide mainly resistance to side loading imposed by concrete against the web. Inserts 1150A are shown as rods or bars extending within the cells 1130 at selected locations depending on loading factors. The inserts 1150 are particularly important when the joint 1100 is used for thick concrete pads such as roadways which are poured to a thickness as much as 12".

It will also be apparent that the various control joint figurations such as those shown in FIGS. 1, 3, 5, 6, 7 and 9 may also be fabricated as an extrusion having a honeycomb configuration. The advantages and benefits arising from this construction have been set out in detail above and need not be reiterated here.

It will be obvious to those skilled in the art to make various changes, alterations, and modifications to the invention described herein. To the extent that these various changes, alterations, and modifications do not depart from the spirit and scope of the appended claims, they are intended to be encompassed therein.

We claim:

1. A control joint for use in casting concrete sections on a supporting base, said control joint comprising:

(a) a base; and (b) a web having opposite sides, said web tapering upwardly from said base to a top and integrally formed therewith, said base and web being formed as an integral extruded member defining a honeycomb structure with a single web associated with the base, the base extending oppositely from said web.

2. The control joint of claim 1 fabricated from a plastic of the group consisting of polyurethane, polyvinyl chloride or styrene.

3. The control joint of claim 1 wherein said web includes spaced-apart holes extending through the web.

4. The control joint of claim 3 wherein said base includes spaced-apart holes extending through the base.

5. A control joint for use in casting concrete sections on a supporting base, said control joint comprising:

(a) a base;

(b) a web having opposite sides, said web extending upwardly from said base to a top and integrally formed therewith, said base and web being formed as an integral extruded member defining a honeycomb structure with a single web associated with the base; and (c) locking tabs oppositely extending from the sides of said web intermediate said base and top.

6. A control joint for use in casting concrete sections on a supporting base, said control joint comprising:

(a) a base;

(b) a web having opposite sides, said web extending upwardly from said base to a top and integrally formed therewith, said base and web being formed as an integral extruded member defining a honeycomb structure with a single web associated with the base; and (c) a projection depending downwardly from the base generally aligned with the web, said leveling projection being engageable in a concrete pad.

7. A control joint for use in casting concrete sections on a supporting base, said control joint comprising:

(a) a base;

(b) a web having opposite sides, said web extending upwardly from said base to a top and integrally formed therewith, said base and web being formed as an integral extruded member defining a honeycomb structure; and (c) said web defining a plurality of spaced-apart slots extending from said top spaced and sized to receive and support wire mesh reinforcing.

8. A control joint for use in casting concrete sections on a supporting base, said control joint comprising:

(a) a base;

(b) a web having opposite sides, said web extending upwardly from said base to a top and integrally formed therewith, said base and web being formed as an integral extruded member defining a honeycomb structure; and (c) reinforcing members located within said honeycomb structure.

9. The control joint of claim 8 wherein said base and web are extruded plastic and said reinforcing members comprise metal sections.

10. A control joint for use in casting concrete sections on a supporting base, said control joint comprising:

(a) a plurality of control joint sections each having:

i. a base;

ii. a web having opposite sides, said web extending upwardly from said base to a top and integrally formed therewith, said base and web being formed as an integral extruded member defining a honeycomb structure; and (b) clip means defining openings to receive the base and web of adjacent sections to secure them together.

* * * * *